US007762287B2

(12) United States Patent
Liao

(10) Patent No.: US 7,762,287 B2
(45) Date of Patent: Jul. 27, 2010

(54) STRETCH WOVENS WITH SEPARATED ELASTIC YARN SYSTEM

(75) Inventor: Tianyi Liao, Chadds Ford, PA (US)

(73) Assignee: INVISTA North America S.a.r.l., Wilmington, DE (US)

( * ) Notice: Subject to any disclaimer, the term of this patent is extended or adjusted under 35 U.S.C. 154(b) by 0 days.

(21) Appl. No.: 12/020,165

(22) Filed: Jan. 25, 2008

(65) Prior Publication Data

US 2009/0191777 A1 Jul. 30, 2009

(51) Int. Cl.
*D03D 15/08* (2006.01)
*D03D 25/00* (2006.01)

(52) U.S. Cl. ..... 139/422; 139/421; 139/383 R

(58) Field of Classification Search ..... 139/383 R, 139/420 R, 421, 422, 426 R, 420 A
See application file for complete search history.

(56) References Cited

U.S. PATENT DOCUMENTS

| | | | | | |
|---|---|---|---|---|---|
| 3,154,111 | A | * | 10/1964 | Marshall | 139/420 R |
| 3,169,558 | A | | 2/1965 | Aleixo et al. | |
| 3,315,328 | A | * | 4/1967 | Ibrahim | 28/156 |
| 3,452,411 | A | * | 7/1969 | Brown | 28/156 |
| 3,788,365 | A | * | 1/1974 | Campbell et al. | 139/421 |
| 3,788,366 | A | * | 1/1974 | Campbell et al. | 139/421 |
| 3,858,622 | A | * | 1/1975 | Campbell et al. | 139/421 |
| 3,860,046 | A | * | 1/1975 | Goff et al. | 139/421 |
| 3,908,711 | A | * | 9/1975 | Goff et al. | 139/419 |
| 3,920,054 | A | * | 11/1975 | Goff et al. | 139/421 |
| 3,965,943 | A | * | 6/1976 | Goff et al. | 139/421 |
| 3,965,944 | A | * | 6/1976 | Goff et al. | 139/421 |
| 4,234,022 | A | * | 11/1980 | Okamoto et al. | 139/420 R |
| 4,621,489 | A | * | 11/1986 | Okada | 57/210 |
| 4,861,660 | A | * | 8/1989 | Ishii | 428/371 |
| 5,858,885 | A | * | 1/1999 | Hamilton et al. | 442/184 |
| 5,874,372 | A | * | 2/1999 | Morishita et al. | 442/182 |
| 6,659,139 | B2 | | 12/2003 | Laycock et al. | |
| 2006/0096073 | A1 | * | 5/2006 | Stoppa et al. | 28/166 |
| 2006/0124193 | A1 | * | 6/2006 | Orr et al. | 139/421 |
| 2007/0259583 | A1 | | 11/2007 | Laycock et al. | |

FOREIGN PATENT DOCUMENTS

| | | |
|---|---|---|
| EP | 1676944 A1 | 5/2006 |
| GB | 1513273 | 6/1978 |
| JP | 06-057581 | 3/1994 |
| JP | 09-132839 | 5/1997 |
| JP | 2002-013045 | 1/2002 |
| KR | 10-0257338 | 2/2000 |

* cited by examiner

*Primary Examiner*—Bobby H Muromoto, Jr.
(74) *Attorney, Agent, or Firm*—Christina W. Geerlof

(57) ABSTRACT

Included is a woven fabric having warp yarns and weft yarns. Either warp yarn or weft yarn or both warp and weft yarns have two separate systems of yarns. The systems of yarns include a hard yarn forming the main body of fabric and a composite covered elastic yarn with an elastic fiber core; wherein the fabric has an outer face side, a back side, and the fabric includes at least one of: (a) a weaving pattern where the composite yarn and at least one adjacent hard yarn pass over the same pick when the composite yarn is on the outer surface; (b) the ratio of hard yarn denier to composite yarn denier is at least 1:1; and (c) the composite yarn floats over no more than 5 picks on the outer face side.

14 Claims, 11 Drawing Sheets

STRETCH WOVENS WITH SEPARATED ELASTIC YARN SYSTEM

BACKGROUND OF THE INVENTION

1. Field of the Invention

This invention relates to the manufacture of woven fabrics with stretch in warp and/or weft direction. It specifically relates to fabrics and methods including a separated yarn system including an elastic core composite yarn system and a rigid base yarn system.

2. Summary of Related Art

Stretch woven fabrics or stretch wovens have been produced for many years. Fabric manufacturers generally know the importance of the right quality parameters to achieve fabrics acceptable to consumers. However, in these commercially available fabrics, the main body of the stretch fabric is formed by elastic composite yarn itself. Elastic yarn provides a double function: (1) the stretch yarn forms the base of the fabric to provide cover, aesthetic, and hand; and (2) the stretch yarn provides elasticity to provide stretch-recovery function. In many cases, the fabric appearance and performance are compromised by stretch function. Generally stretch fabrics have different appearance from rigid ones that do not include elastic yarns. Due to the inclusion of elastic yarn, many textile processes are difficult to conduct, such as indigo yarn dye for denim and package yarn dye for shirts. Also, textile production efficiency is reduced during processing elastic yarn. In most cases, extra contractive force exists within fabrics, resulting in poor fabric dimension stability. In order to provide such an elastic containing fabric with dimensional stability, heatsetting is a necessary process to control fabric shrinkage.

For stretch fabric, most elastic or elastomeric yarns are used in combination with relatively inelastic fibers, such as polyester, cotton, nylon, rayon or wool. However, for the purposes of this specification, such relatively inelastic fibers will be termed "hard" fibers.

Conventional composite yarns including spun cotton and elastomer fiber are typically dyed as packages before use in weaving, but there are disadvantages. Specifically, the elastomer core yarn will retract at the hot-water temperatures used in package dyeing. In addition, the composite yarn on the package will compress and become very tight, thereby impeding the flow of dyestuffs into the interior of the yarn package. This can often result in yarn with different color shades and stretch levels, depending on the yarn's diametrical position in the dyed package. Small packages are sometimes used for dyeing core-spun composite yarns to reduce the problem. However, small-package dyeing is relatively expensive because of extra packaging and handling requirements.

Although common industry practices are highlighted above, additional references are described hereinbelow to demonstrate attempts to improve weaving processes and/or products. For example, U.S. Pat. No. 3,169,558 discloses a woven fabric with bare spandex in one direction and hard yarns in the other direction. However, the bare spandex must be draw twisted in a separate process, and spandex could be exposed on fabric surface.

Great Britain Patent GB 15123273 discloses a warp-stretch woven fabric and process where pairs of warp yarns, each pair having a bare elastomer fibers and a secondary hard yarn, are passed in parallel and at different tensions through the same heald eyelet and dent. However, the spandex is also visible on the face and back of fabric.

Japanese published Application 2002-013045 discloses a process used to manufacture a warp-stretch woven fabric using both composite and hard yarns in the warp. The composite yarn comprises polyurethane yarn wrapped with a synthetic multifilament hard yarn and then coated with size material. The construction of the composite is that of the composite yarns represented in FIG. 3, before coating with size material. The composite yarn is used in the warp in various proportions to a separate synthetic multifilament hard yarn in order to achieve the desired properties of stretch in the warp direction. This composite yarn and method were developed to manufacture warp-stretch fabrics, and to avoid difficulties in the weaving of weft-stretch fabrics. However, the elastic yarns have the same size as hard yarn and exposed on the fabric surface.

U.S. Pat. No. 6,659,139 describes a way to reduce grin-through of bare elastomer in warp direction of twill fabric. However, the elastomers are used in bare form and elastomer slippage occurs after the garment is washed. The workable fabric structure window is narrow and the weaving efficiency is low.

Therefore, there is a need to produce stretch wovens, which are low shrinkage, easy process, friendly garment making.

SUMMARY OF THE INVENTION

In some embodiments are an article including a woven fabric having warp yarns and weft yarns. Either warp yarn or weft yarn or both warp and weft yarns have two separate systems of yarns. The systems of yarns include a hard yarn forming the main body of fabric and a composite covered elastic yarn with an elastic fiber core;

wherein the fabric has an outer face side, a back side, and the fabric includes at least one of:

(a) a weaving pattern where the composite yarn and at least one adjacent hard yarn pass over the same pick when the composite yarn is on the outer surface;

(b) the ratio of hard yarn denier to composite yarn denier is at least 1:1; and (c) the composite yarn floats over no more than 5 picks on the outer face side.

In another embodiment is an article including a woven fabric having warp yarns and weft yarns. Either warp yarn or weft yarn or both warp and weft yarns have two separate systems of yarns. The systems of yarns include a hard yarn forming the main body of fabric and a composite covered elastic yarn with an elastic fiber core;

wherein the fabric has an outer face side, a back side, and the fabric includes:

(a) a weaving pattern where the composite yarn and at least one adjacent hard yarn pass over the same pick when the composite yarn is on the outer surface;

(b) the ratio of hard yarn denier to composite yarn denier is at least 1:1; and (c) the composite yarn floats over no more than 5 picks on the outer face side.

Also included is a method of making an article including: weaving a fabric having warp yarns and weft yarns. Either warp yarn or weft yarn or both warp and weft yarns have two separate systems of yarns. The systems of yarns include a hard yarn forming the main body of fabric and a composite covered elastic yarn with an elastic fiber core;

wherein the fabric has an outer face side, a back side, and includes at least one of:

(a) a weaving pattern where the composite yarn and at least one adjacent hard yarn pass over the same pick when the composite yarn is on the outer surface;

(b) the ratio of hard yarn denier to composite yarn denier is at least 1:1; and (c) the composite yarn floats over no more than 5 picks on the outer face side.

BRIEF DESCRIPTION OF THE FIGURES

The detailed description will refer to the following drawings, wherein like numerals refer to like elements and wherein.

DETAILED DESCRIPTION OF THE INVENTION

Figure 1:
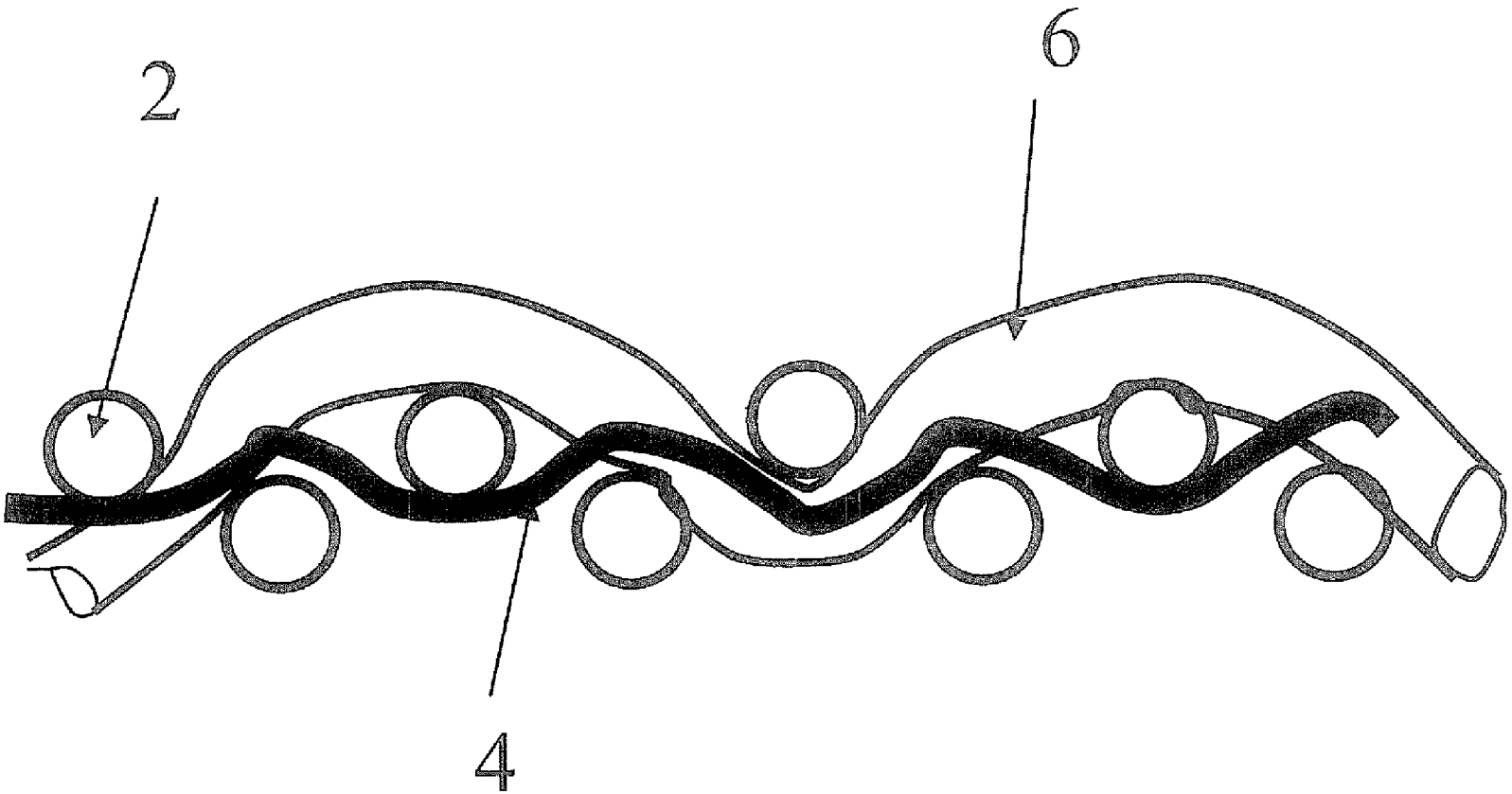
FIG. 1 is an illustrated fabric structure with double warp yarn system.

Elastomeric fibers are commonly used to provide stretch and elastic recovery in woven fabrics and garments. "Elastomeric fibers" are either a continuous filament (optionally a coalesced multifilament) or a plurality of filaments, free of diluents, which have a break elongation in excess of 100% independent of any crimp. An elastomeric fiber when (1) stretched to twice its length; (2) held for one minute; and (3) released, retracts to less than 1.5 times its original length within one minute of being released. As used in the text of this specification, "elastomeric fibers" means at least one elastomeric fiber or filament. Such elastomeric fibers include but are not limited to rubber filament, biconstituent filament and elastoester, lastol, and spandex. The terms "elastomeric" and "elastic" are used interchangeably throughout the specification.

"Spandex" is a manufactured filament in which the filament-forming substance is a long chain synthetic polymer comprised of at least 85% by weight of segmented polyurethane.

"Elastoester" is a manufactured filament in which the fiber forming substance is a long chain synthetic polymer composed of at least 50% by weight of aliphatic polyether and at least 35% by weight of polyester.

"Biconstituent filament" is a continuous filament comprising at least two polymers adhered to each other along the length of the filament, each polymer being in a different generic class, for example, an elastomeric polyetheramide core and a polyamide sheath with lobes or wings.

"Lastol" is a fiber of cross-linked synthetic polymer, with low but significant crystallinity, composed of at least 95 percent by weight of ethylene and at least one other olefin unit. This fiber is elastic and substantially heat resistant.

A "covered" elastomeric fiber is one surrounded by, twisted with, or intermingled with hard yarn. The covered yarn that comprises elastomeric fibers and hard yarns is also termed a "composite yarn" in the text of this specification. The hard-yarn covering serves to protect the elastomeric fibers from abrasion during weaving processes. Such abrasion can result in breaks in the elastomeric fiber with consequential process interruptions and undesired fabric non-uniformities. Further, the covering helps to stabilize the elastomeric fiber elastic behavior, so that the composite yarn elongation can be more uniformly controlled during weaving processes than would be possible with bare elastomeric fibers. The terms "elastic core yarn", "elastic core end", "core end", "composite yarn", "core yarn" and "composite elastic core yarn" are all used interchangeably throughout the specification.

The composite yarns include: (a) single wrapping of the elastomer fibers with a hard yarn; (b) double wrapping of the elastomer fibers with a hard yarn; (c) continuously covering (i.e., core-spinning) an elastomer fiber with staple fibers, followed by twisting during winding; (d) intermingling and entangling elastomer and hard yarns with an air jet; and (e) twisting an elastomer fibers and hard yarns together.

"Grin-through" is a term used to describe the exposure, in a fabric, of composite yarn to view. Grin-through can manifest itself as an undesirable glitter. If a choice must be made, low grin-through on the face side is more desirable than low grin-through on the back side.

The stretch fabric of the some embodiments includes non-elastomeric base yarn warp ends (called base ends) and elastic core composite yarn warp ends (called core ends). In some embodiments, a fabric with unexpectedly high stretch and recovery properties were achieved with comparatively low amounts of elastic fibers. This was accomplished by the use of a duo system of yarns in the warp. Those of skill in the art will recognize that where weft stretch is desired, the fabric may include non-elastomeric base yarn weft ends and elastic core weft yarns.

Some embodiments provide a method for making a stretch fabric that includes providing the fabrics with two separated yarn systems (as shown in FIG. 1): The base yarn system 6 and elastic core yarn systems 4. The base yarn system 6 performs aesthetical, appearance, hand feel. The elastic core yarn system 4 performs stretch and recovery function. The weft yarn 2 is shown as a cross-section in FIG. 1 and includes hard yarn and optionally an elastic yarn, including a composite elastic core yarn.

In some embodiments are fabrics that include a covered composite yarn as the elastic core system. These composite elastic yarns are hidden inside the fabric by the adjacent hard yarns and are not visible on the fabric surface. In addition to the benefit of providing high stretch and recovery with a relatively small amount of elastic yarn, another advantage of these fabrics is that a heat setting step is not required to provide the fabric with dimensional stability (i.e., the fabric edges are substantially free of edge curl and the fabric maintains the shape as woven without distortion caused by the retractive force of the elastic yarn).

Another embodiment of the invention further provides fabrics and a method of making stretch fabric wherein the elastic core yarn is covered spandex yarn. The bare spandex yarn (prior to covering to form the composite yarn) may be from about 11 dtex to about 444 dtex (denier—about 10 D to about 400 D), including 11 dtex to about 180 dtex (denier 10 D to about 162 D). The spandex yarn is covered with one or more hard yarns, with yarn count from 6 to 120 Ne. During the covering process, the spandex yarn is drafted between 1.1× to 6× its original length.

The fabrics of some embodiments include an elastic core yarn that is substantially invisible on the fabric surface. This is accomplished in part by including a hard yarn that has at least the same denier as the elastic core yarn, and desirably, a base yarn that has a greater denier than the elastic yarn. The ratio of yarn denier of base yarn to the elastic core yarn is from about 1:1 to about 20:1 and about 5:4 to about 20:1, including from about 2:1 to about 10:1. Other suitable ratio ranges of the base yarn weight to the elastic core yarn weight include 5:4 to about 15:1, 3:2 to about 15:1, and 3:2 to about 10:1.

The elastomer fiber content with the core yarn is between about 0.1% to about 50%, including from about 0.5% to about 40%, and about 5% to about 30% based on the weight of the yarn. Elastomeric fiber content within the fabric may be from about 0.01% to about 5% by weight based on the total fabric weight, including from about 0.1% to about 3%. Also provided are fabrics and a method for making a stretch fabric where various weave patterns can be applied, including plain, poplin, twill, oxford, dobby, sateen, satin and combinations thereof.

The elastic core yarn may be combined with the hard yarn during the weaving warping, beaming or sizing operations. The fabric finishing includes one or more steps selected from the group consisting of: scouring, bleaching, mercerization, dyeing, drying and compacting and any combination of such steps.

The fabrics of some embodiments may have an elongation from about 10% to about 45% in the warp or/and weft direction. The fabrics may have shrinkage of about 10% or less after washing. The stretch woven fabric may have an excellent cotton hand feel. Garments may be prepared from the fabrics described herein.

The hard base yarn included in some embodiments can be, for example, spun staple yarns, such as cotton, wool or linen, and the filaments. They also can be of mono component poly(ethylene terephthalate) and poly(trimethylene terephthalate) fiber, polycaprolactam fiber, poly(hexamethylene adipamide) fibers acrylic fibers, modacrylic, acetate fibers, rayon fibers, Nylon and combinations thereof.

The content composite of composite core elastic yarn may be about 30% or less by weight based on the weight of the all warp yarns. For a fabric having a weight of 5 oz/yard$^2$ and heavier, an acceptable elastomeric fiber content in the warp may be about 2% or lower of total warp yarn weight, including from about 0.2% to about 2%, and about 1% or less of total fabric weight. For the fabrics weighing less than 5 oz/yard$^2$, an acceptable elastomeric fiber content in warp may be less than about 5% of total warp yarn weight, including from about 1% to about 5%, and less than 3% of total fabric weight.

The amounts of elastic fiber that have been found to provide acceptable levels of stretch and recovery for the inventive fabrics of some embodiments are in contrast to those found in conventional fabrics. For conventional stretch wovens heavier than 5 oz/yard$^2$, the elastomeric fiber content is normally higher than 2%. For the inventive fabrics, the elastomeric fiber content can be lower about 1%, and even about 0.2% or less, while still providing good stretch and recovery. One reason is that the weave pattern of core elastic yarn can be different from the weave patter of the base yarn. Therefore, the composite elastic core yarn power can be used more effectively. Also, the yarn diameter of elastic core yarn is much smaller than base yarn; the elastic core yarn migrates into the center of fabric in relaxation steps during the finishing and dyeing process, allowing the elastomeric fiber to give stretch and recovery more effectively. A further contrast of conventional fabrics is that the composite yarns included in conventional fabrics are exposed on fabric surface, and the weaving pattern is the same as other surface yarns.

The weft yarn can be the same as, or different from, the warp yarns. The fabric can be warp-stretch only, or it can be bi-stretch, in which useful stretch and recovery properties are exhibited in both the warp and weft directions. Such weft stretch can be provided by bicomponent filament yarn, spandex, melt-spun elastomer, and the like.

When the weft yarns include an elastic yarn, they can include a second yarn (optionally a spun staple yarn), for example, in a pick-and pick or co-insertion construction. When an elastic yarn or fiber is included in the weft, including when the elastic yarn is a composite elastic core yarn, the amount of elastic yarn present in the weft may be from about 0.2% to about 5% by weight of the weft yarns, including from about 0.2% to about 2%.

The ratio of base (hard yarn) ends to core elastic ends may be from about 2:1 to about 8:1. Other acceptable rations of the base ends to core ends may be from about 4:1 to about 8:1 and about 4:1 to about 6:1. If the ratio is too low, the core ends can be excessively exposed to the surface of the fabric, resulting in undesirable visual and tactile aesthetics. When the ratio is too high, the fabric can have undesirably low stretch and recovery properties.

The core ends float over no more than 6 picks on the face side of fabric depending on the weaving pattern. The core ends may further not float over more than 5 picks or 4 picks to exclude the composite elastic yarn from having surface visibility. On the back side of the fabric, core ends may float over no more than 6 picks, no more than 5, 4, or 3 picks depending on the weaving pattern. When the core ends float is too long, the fabric can have an uneven surface and snagging. Also, grin-through can become unacceptable.

Figure 2:
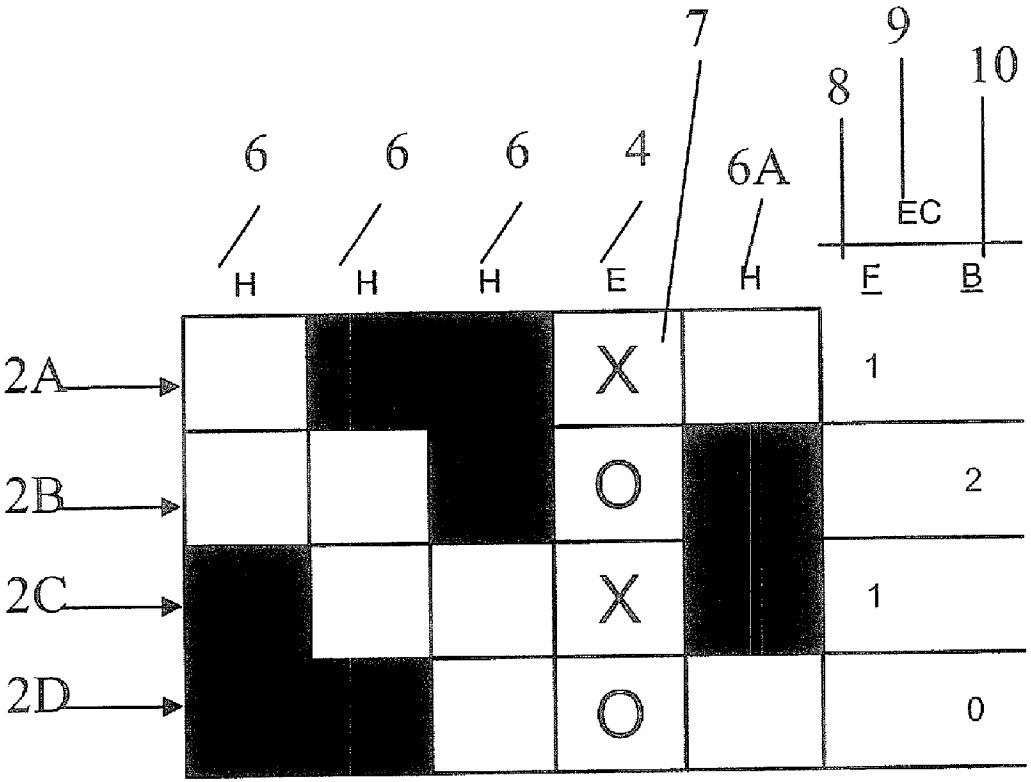
FIG. 2 is a lift plan of 2/2 twill base +1/1 core fabric structure.

"Core end exposure count" denotes the number of non-elastomeric (warp-direction) surface ends adjacent to each core end which are on the opposite side (weft-direction) of the pick yarn or continuous filament at a given pick, compared to the core end. The count can be for the face or the back of the fabric, depending on whether the core end is on the face or the back at the pick in question, and can have integral values of zero, one, or two. For example, in the lift plan shown in FIG. 2, surface ends are shown in a 2/2 twill pattern into which one core end has been woven. "H" 6 indicates a non-elastomeric ('hard') surface end, and "E" 4 indicates an elastic core end. "EC" 9 is an abbreviation for exposure count, "F" 8 for face side, and "B" 10 for back side. As in all the Figures, a filled (darkened) square indicates a non-elastomeric surface end passing over a pick, an empty square indicates a non-elastomeric surface end passing under a pick, an "X" indicates a core elastic end passing over a pick, and an "O" indicates a core elastic end passing under a pick. The yarns 2 in the weft direction are also indicated. The numbers under "EC" 9 indicate the core end exposure count for each pick. At the first pick 2A of the pattern repeat, the core elastic end 7 is on the face side of the fabric, and one adjacent non-elastomeric surface end 6A is on the back side of the fabric, so the elastic core end face exposure count for that pick is one. At the second pick 2B, the core elastic end is on the back, and both adjacent non-elastomeric surface ends are on the front, so the back exposure count is two. At the third pick 2C, the core elastic end is on the face and one adjacent non-elastomeric surface end is on the back, so the core elastic end face exposure count for that pick is one. At the last pick 2D of the pattern repeat, the composite core end is on the back as are both adjacent non-elastomeric surface ends, so the elastic core end back exposure count is zero.

The fabric of some embodiments has an elastic core end face exposure count no higher than one in a pattern repeat, and desirably a face exposure count of zero in a pattern repeat. In other words, at least one adjacent hard yarn passes over the same pick when the composing yarn is on the outer face surface. Grin-through is further decreased when a composite end is on the face side and at least one adjacent non-elastomeric end floats over less than 2 picks on the face side. When the face exposure count is two, grin-through of the core composite yarn on the face can be unacceptably high, especially when the core end floats over 2 or 3 picks. To prepare a more uniform fabric that minimizes exposure and grin-through of the core yarn the fabric should have a core end back exposure count no higher than one.

Figure 3:
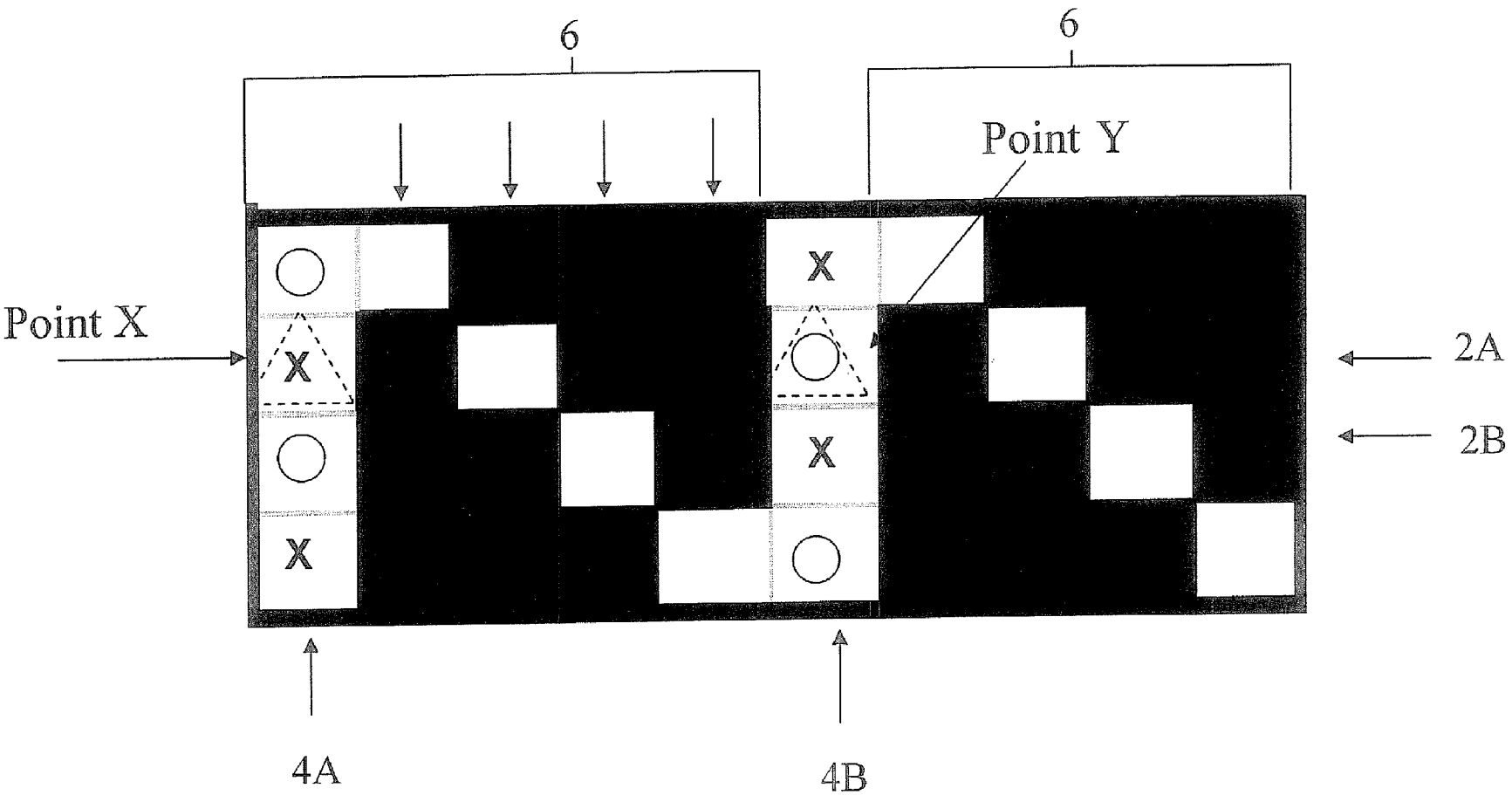
FIG. 3 Lift Plan for 3/1 twill +1/1 Dis-match Structure.

The weave structure in FIG. 3 with dismatch core end pattern can provide even better appearance on the fabric surface. In FIG. 3, there are two elastic core yarn: core yarn I and core yarn 11. Four hard base yarns 6 exist between two elastic yarns 4A and 4B. Interweaving Point X is the cross weaving point between weft yarn 2A and elastic yarn 4A. In this point, the elastic yarn pushes the weft yarn toward back of fabric. However, in Point Y where elastic core yarn 4B interweaves with weft yarn 2A, core elastic yarn pushes the weft yarn toward surface of the fabric. The result is for the whole weft yarn to be kept in the center of the fabric. There is no weft strip on fabric surface. In contrast, for the weave pattern in FIG. 4, core elastic yarns have same interlacing pattern along the weft yarn individually. But for weft yarn 2A in Point X, elastic yarn 4A pushes the weft yarn toward back of fabric, and in neighbor point (Point Y), Core elastic yarn 4B also pushes the weft yarn toward back of the fabric. Therefore, for whole weft yarn 2A, it will be toward the back of fabric. For an adjacent weft yarn 2B, it is pushed toward the surface of the fabric by elastic yarns 4A and 4B. So, there could be a weft strip on fabric surface.

The composite core yarn can be present in any desired amount for example from about 5 to about 20 weight percent based on total fabric weight when no composite elastic yarn is present in the weft (i.e., when the composite yarn only present in the warp). When composite elastic core yarn is present in both warp and weft, the composite yarn may be present in greater amounts, for example, from about 10% to 40% by weight.

The composite core yarn includes various composite yarn, such as single wrapping of the elastomer fibers with a hard yarn; double wrapping of the elastomer fibers with a hard yarn; continuously covering (i.e., core-spinning) an elastomer fiber with staple fibers, followed by twisting during winding; intermingling and entangling elastomer and hard yarns with an air jet; and twisting an elastomer fibers and hard yarns together.

The linear density of the composite yarn from which the fabric of some embodiments are prepared can range from about 15 denier (16.5 dtex) to about 900 denier (990 dtex), including from about 30 denier to 300 denier (33 dtex to 330 dtex). When the ratio of yarn denier between composite yarn and hard yarns is lower than 0.8, the fabric has no substantial grin-through. After the finishing process, core yarns migrate into the center of fabric, are invisible and untouchable.

Figure 5:
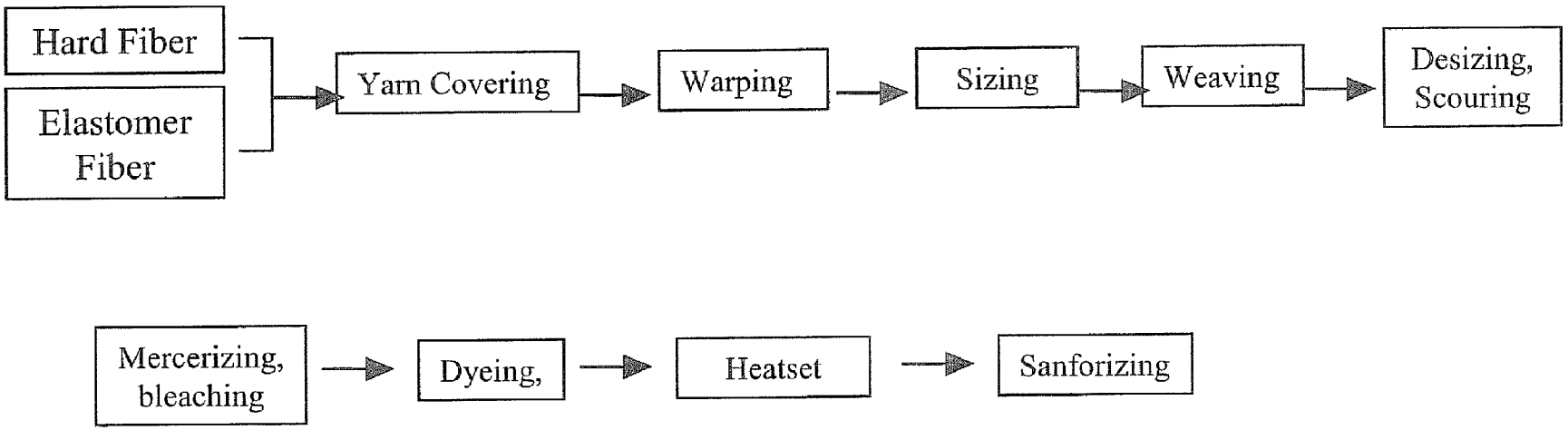
FIG. 5 is a block diagram of a conventional fabric processing routine.
Figure 6:
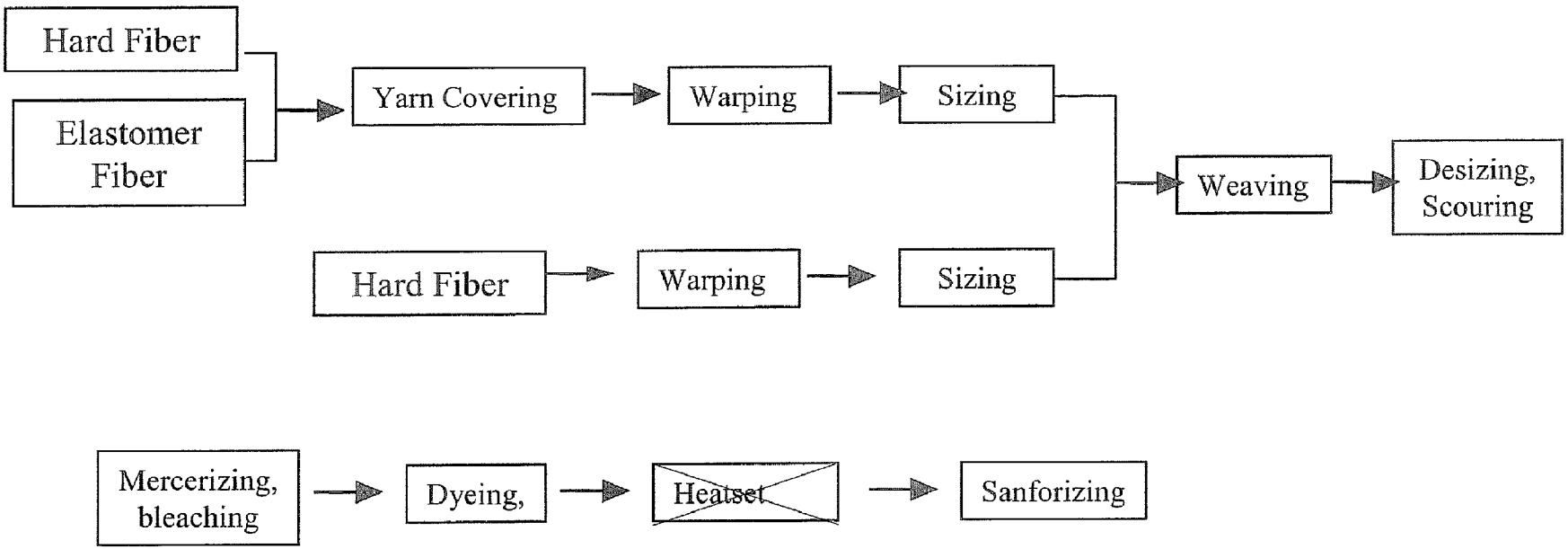
FIG. 6 is a block diagram of an inventive processing routine for weaving combination.

In one embodiment of the method of this invention, the composite yarn is combined together with base yarn during weaving operation. FIG. 5 shows a conventional processing routine for stretch fabric. The inventive processing routine for this invention is shown in FIG. 6. The rigid warp and elastic warp beam are made separately. The weaving machines with double beam ability are necessary. Normally, the hard base yarn beam is located in the bottom on loom. The beam with elastic core yarn is put on the top. Both base and core yarns are fed from the beam and pass over a whip roll or rollers, which control yarn tension variations during weaving motions. The yarns are then directed through drop wires, heddles, and a read. Base yarn and core yarns can be in the same dent. All the warp yarns weaving alike in a designed repeat occupy a given harness. The reed establishes the width of the warp sheet and equal spacing of the yarn before weaving. It also is the mechanism used for pushing (beating-up) each inserted filling yarn (pick) into the body of fabric at the "fell of the cloth". The fell is the point where yarns become fabric. At this point, the base yarn, core warp yarn and weft are in fabric form and ready to be collected on a cloth roll.

Figure 7:
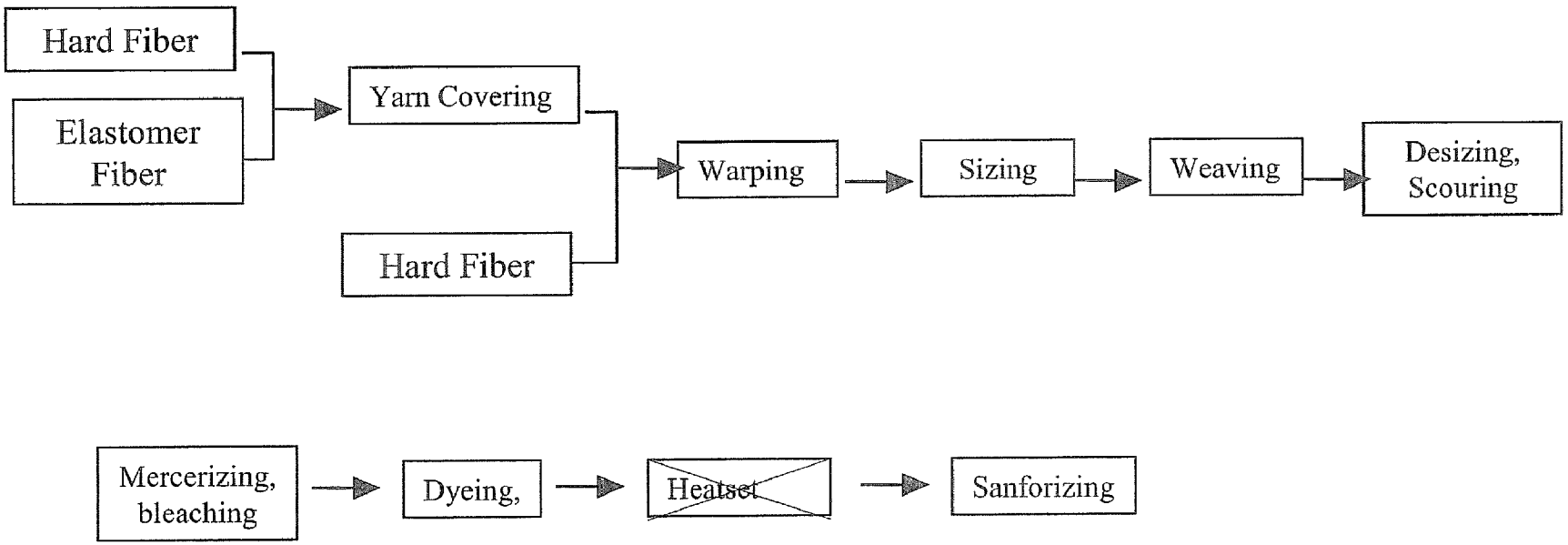
FIG. 7 is a block diagram of an inventive processing routine for warping combination.
Figure 8:
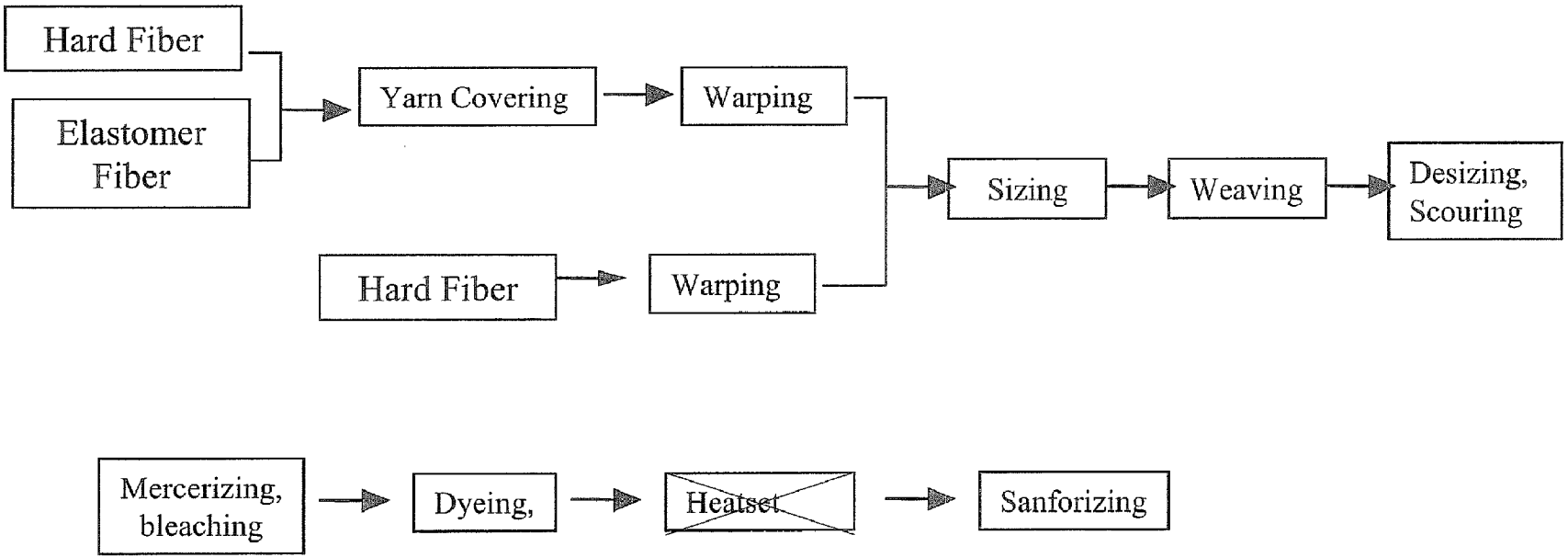
FIG. 8 is a block diagram of an inventive processing routine for sizing combination.

The core yarn and base yarn also can be combined together during a warping operation. The processing procedure is shown in FIG. 7. Warping is the process of transferring multiple yarns from individual yarn package onto a single package assembly. Normally, yarns are collected in a sheet form where the yarns lie parallel to each other and in the same plane onto a beam, which is a cylindrical barrel with side flanges. The supply yarn packages are placed on spindles, which are located in a frame work called a creel. Core yarn and base yarn are put on the creel in certain position. Then they are pulled out and form a mixed sheet in required pattern. Finally, they are wound into beam together (FIG. 8).

The core yarn also can be mixed with hard yarn during slashing (sizing) process. The main purpose for sizing warp yarn is to encapsulate the yarn with a protective coating. This protective coating reduces yarn abrasion that takes place during the weaving operation. And reduces yarn hairiness preventing adjacent yarns from entangling with one another at the weaving machine. The core yarn is mixed with surface yarn within sizing machine. At the back end of the slasher range, the section beams from the beaming process are creeled. The yarn from each beam will be pulled over and combined with the yarns from the other beams to form multiple sheets of yarns, the number of sheets corresponding to the number of size boxes on the machine. In size box, the yarns are guided downward and submerged in the liquid size. The yarn sheet laves the size box via a set of squeeze rolls that helps controls the amount of penetration of the size into yarn. After this, the yarn and controls the amount of penetration of the size into they yarn. After this, the yarn pulled over steam heated, dry can or cylinders where drying takes place. At this point, the yarns are not totally dry, but are monitored to maintain required moisture. Most warp yarns have 4-14% size add-on (actual dry solids weight added to the original weight of the yarn). This depends on what type of warp yarn. Too much size cause yarn chaffing and excessive shedding of size particles at the weaving machine, and too little size causes excessive yarn abrasion resulting in dye streaks clinging, broken and entangled ends resulting in low weaving efficiencies.

All yarns go through a set of stainless steel split rods, which help to separate them into individual sheets. This ensures that yarns from one sheet are adhering to yarns from another sheet. After passing through the split rods, the warp yarn are collected into on single sheet and passed through a comb, which helps to separate individual yarns. This expansion type of comb is adjusted to the desired loom beam width. At this point, all the warp yarn, surface yarn and core yarn are wound onto the loom beam. Normally, several loom beams will be produced from a single set of section beams in the slasher creel.

The combination of a base yarn and elastic core yarn structures also can be used in the weft direction. During the weaving process, base yarn and elastic core yarns may be inserted into fabrics as fill yarns. They can be introduced by single pick or double pick during one weft insertion. Air jet loom, rapier loom, projectile loom, water jet loom and shuttle loom can be used.

The core elastic yarn is substantially invisible on the fabric surface after the fabric is relaxed. FIG. 1 shows the structure. Because of lower crimp height of core yarn 4, and the lean of hard yarns 2 and 6 toward core yarn, core yarn is located at the center of fabric, basically covered by surface yarns 2 and 6 and invisible and untouchable.

Dyeing and finishing process are important in producing a satisfactory fabric. The fabric can be finished in continuous range processes and the piece dye jet processes. Conventional equipment found in a continuous finishing plant and piece dye factories are usually adequate for processing. The normal finishing process sequences include preparation, dyeing and finishing. In preparation and dyeing process, including in singing, desizing, scouring, bleaching, mercerizing and dyeing, normal processing methods for elastic wovens are usually satisfactory.

Finishing processing is a more critical step in producing satisfactory inventive fabrics with bi-stretch (i.e., fabrics that stretch in weft as well as warp direction). Finishing is conducted normally in a tenter frame. The main purposes of the finishing process in tenter frame are to pad and cure the softener, wrinkle resistant resin and to heatset the spandex.

Unexpectedly, it is also was found that the heatset process may not be required for this stretch woven fabric. The fabric meets many end use specifications without heat setting. The fabric maintains shrinkage of less than about 10% even without heatset. Heat setting "sets" spandex in an elongated form. This is also known as re-deniering, wherein a spandex of higher denier is drafted, or stretched, to a lower denier, and then heated to a sufficiently high temperature, for a sufficient time, to stabilize the spandex at the lower denier. Heat setting therefore means that the spandex permanently changes at a molecular level so that recovery tension in the stretched spandex is mostly relieved and the spandex becomes stable at a new and lower denier. Heat setting temperatures for spandex are generally in the range of 175° C. to 200° C. Heat setting conditions for conventional spandex are for about 45 seconds or more at about 190° C.

In conventional fabrics, if heat setting is not used to "set" the spandex, the fabric may have high shrinkage, excessive fabric weight, and excessive elongation, which may result in a negative experience for the consumer. Excessive shrinkage during the fabric finish process may result in crease marks on the fabric surface during processing and household washing. Creases that develop in this manner are frequently very difficult to remove by ironing.

By eliminating the high-temperature heat setting step in the process, the new process may reduce heat damage to certain fibers (i. e. cotton) and thus may improve the handle of the finished fabric. The fabrics of some embodiments may be prepared in the absence of a heat setting step including where the fabrics will be prepared into garments. As a further benefit, heat sensitive hard yarns can be used in the new process to make shirting, elastic, fabrics, thus increasing the possibilities for different and improved products. In addition, the shorter process has productivity benefits to the fabric manufacturer.

For many end uses, composite yarns containing elastic yarn need to be dyed before weaving. Package yarn dyeing is the simplest and most economical method for processing composite yarns. For typical composite yarns including cotton and elastomeric fiber(s), there are disadvantages during yarn package dye processing. Specifically, the elastomeric core yarn will retract at the hot water temperatures used in package dyeing. In addition, the composite yarn on the package will compress and become very tight, thereby impeding the flow of dyestuffs into the interior of the yarn package. This often can result in yarn with different color shades and stretch levels, depending on the yarn's diametrical position within the dyed package. Small packages are sometimes used for dyeing composite yarns to reduce this problem. However, small-package dyeing is relatively expensive because of extra packaging and handling requirements.

In conventional fabrics, some other yarn dyeing methods are also used, such as skein yarn dye, indigo yarn beam dye and rope dyeing. Elastic composite yarns have technical difficulties and consistency and quality issues with these processes.

In the inventive fabrics, composite yarns are used as core yarn. The composite core yarns are buried in the center of fabric without substantial grin-through. Therefore, composite yarn dyeing process could be eliminated. Only hard base yarn need to be dyed as desirable color. Elastic core yarn can be used with its natural color without dyeing.

It is found that several of hard yarn can be used as rigid fiber in composite yarn. Such as cotton, wool, polyester filament and Nylon filament. These hard yarns provide opportunity to add extra function into fabrics. Such as polyester and nylon filament will increase the tenacity of cotton fabrics and improve the wrinkle resistant abilities. Cotton and wool yarn increase the moisture of synthetic fabrics. Special function yarns can also be introduced. For example, COOLMAX® fiber that helps absorb moisture from body and quick deliver to outside or conductible fiber that conducts the electricity may be used. Fibers with anti-biotic and micro-capsules also can be used to provide the fabrics with body care, freshness and easy care properties.

Analytical Methods:

Woven Fabric Elongation (Stretch)

Fabrics are evaluated for % elongation under a specified load (i.e., force) in the fabric stretch direction(s), which is the direction of the composite yarns (i.e., weft, warp, or weft and warp). Three samples of dimensions 60 cm×6.5 cm were cut from the fabric. The long dimension (60 cm) corresponds to the stretch direction. The samples are partially unraveled to reduce the sample widths to 5.0 cm. The samples are then conditioned for at least 16 hours at 20° C.±2° C. and 65% relatively humidity, ±2%.

A first benchmark was made across the width of each sample, at 6.5 cm from a sample end. A second benchmark was made across the sample width at 50.0 cm from the first benchmark. The excess fabric from the second benchmark to the other end of the sample was used to form and stitch a loop into which a metal pin could be inserted. A notch was then cut into the loop so that weights could be attached to the metal pin.

The sample non-loop end was clamped and the fabric sample was hung vertically. A 17.8 Newton (N) weight (4 LB) is attached to the metal pin through the hanging fabric loop, so that the fabric sample is stretched by the weight. The sample was "exercised" by allowing it to be stretched by the weight for three seconds, and then manually relieving the force by lifting the weight. This cycle was carried out three times. The weight was allowed then to hang freely, thus stretching the fabric sample. The distance in millimeters between the two benchmarks was measured while the fabric was under load, and this distance is designated ML. The original distance between benchmarks (i.e., unstretched distance) was designated GL. The % fabric elongation for each individual sample as calculated as follows:

$$\%\ \text{Elongation}\ (E\%)=((ML-GL)/GL)\times 100$$

The three elongation results were averaged for the final result.

Woven Fabric Growth (Unrecovered Stretch)

After stretching, a fabric with no growth would recover exactly to its original length before stretching. Typically, however, stretch fabrics will not fully recover and will be slightly longer after extended stretching. This slight increase in length is termed "growth."

The above fabric elongation test must be completed before the growth test. Only the stretch direction of the fabric was tested. For two-way stretch fabric both directions were tested. Three samples, each 55.0 cm×6.0 cm, were cut from the fabric. These were different samples from those used in the elongation test. The 55.0 cm direction should correspond to the stretch direction. The samples were partially unraveled to reduce the sample widths to 5.0 cm. The samples were conditioned at temperature and humidity as in the above elongation test. Two benchmarks exactly 50 cm apart were drawn across the width of the samples.

The known elongation % (E%) from the elongation test was used to calculate a length of the samples at 80% of this known elongation. This was calculated as $$E(\text{length}) \text{ at } 80\% = (E\%/100) \times 0.80 \times L,$$

where L was the original length between the benchmarks (i.e., 50.0 cm). Both ends of a sample were clamped and the sample was stretched until the length between benchmarks equaled L+E (length) as calculated above. This stretch was maintained for 30 minutes, after which time the stretching force was released and the sample was allowed to hang freely and relax. After 60 minutes the % growth was measured as $$\%\ \text{Growth} = (L2 \times 100)/L,$$

where L2 was the increase in length between the sample benchmarks after relaxation and L was the original length between benchmarks. This % growth was measured for each sample and the results averaged to determine the growth number.

Woven Fabric Shrinkage

Fabric shrinkage was measured after laundering. The fabric was first conditioned at temperature and humidity as in the elongation and growth tests. Two samples (60 cm×60 cm) were then cut from the fabric. The samples were taken at least 15 cm away from the selvage. A box of four sides of 40 cm×40 cm was marked on the fabric samples.

The samples were laundered in a washing machine with the samples and a loading fabric. The total washing machine load was 2 kg of air-dried material, and not more than half the wash consisted of test samples. The laundry was gently washed at a water temperature of 40° C. and spun. A detergent amount of 1 g/l to 3 g/l was used, depending on water hardness. The samples were laid on a flat surface until dry, and then they were conditioned for 16 hours at 20° C.±2° C. and 65% relative humidity±2% rh.

Fabric sample shrinkage was then measured in the warp and weft directions by measuring the distances between markings. The shrinkage after laundering, C%, was calculated as $$C\% = ((L1 - L2)/L1) \times 100,$$

where L1 was the original distance between markings (40 cm) and L2 is the distance after drying. The results are averaged for the samples and reported for both weft and warp directions. Negative shrinkage numbers reflect expansion, which was possible in some cases because of the hard yarn behavior.

Fabric Weight

Woven Fabric samples were die-punched with a 10 cm diameter die. Each cut-out woven fabric sample was weighed in grams. The "fabric weight" was then calculated as grams/square meters.

EXAMPLES

The following examples demonstrate the present invention and its capability for use in manufacturing a variety of light weight fabrics. The invention is capable of other and different embodiments, and its several details are capable of modifications in various apparent respects, without departing from the scope and spirit of the present invention. Accordingly, the examples are to be regarded as illustrative in nature and not as restrictive.

For each of the following 13 examples, 100% cotton open end spun yarn was used as warp yarn. They included two count yarns: 7.0 Ne OE yarn and 8.5 Ne OE yarn with irregular arrangement pattern. The yarns were indigo dyed in rope form before beaming. Then, they were sized and made the weaving beam.

Several composite yarns were used as core yarn in warp direction. Various weft yarns, including LYCRA® spandex/cotton core spun yarns were used as weft yarn. Table 1 lists the materials and process ways that were used to make the core yarn for each example. Table 2 shows the detail fabric structure and performance summary for each fabric. LYCRA® spandex is available from INVISTA S.á r.L., Wichita, Kans. For example, in the column headed Spandex 40 D means 40 denier; 3.5× means the draft of the LYCRA® imposed by the core spinning machine (machine draft). For example, in the column headed 'Hard Yarn', 40's is the linear density of the spun yarn as measured by the English Cotton Count System. The rest of the items in Table 1 are clearly labeled.

Stretch woven fabrics were subsequently made, using the core yarn of each example in Table 1 and surface yarn. Various yarns were used as weft yarns. Table 2 summarizes the yarns used in the fabrics, the weave pattern, and the quality characteristics of the fabrics. Some additional comments for each of the examples are given below. Unless otherwise noted, the shirting fabrics were woven on a Donier air-jet loom. Loom speed was 500 picks/minute. The widths of the fabric were about 76 and about 72 inches in the loom and greige state respectively. The loom has double weaving beam capacity. Core yarn is put on the top of loom and base yarn is put on the bottom of loom.

Each greige fabric in the examples was finished by a jiggle dye machine. Each woven fabric was pre-scoured with 3.0 weight % Lubit®64 (Sybron Inc.) at 49° C. for 10 minutes. Afterwards it was de-sized with 6.0 weight % Synthazyme® (Dooley Chemicals. LLC Inc.) and 2.0 weight % Merpol® LFH (E. I. DuPont Co.) for 30 minutes at 71° C. and then scoured with 3.0 weight % Lubit® 64, 0.5 weight % Merpol® LFH and 0.5 weight % trisodium phosphate at 82° C. for 30 minutes. Fabric finishing was followed by dry in a tente frame at 160° C. for 1 minute. No heat setting was performed on these fabrics.

TABLE 1

| Example | Core elastic yarn | Core Warp Yarn Description: Elastic fiber Lycra Dtex (Denier) | Componion hard yarn | Lycra Draft | Composite form |
|---|---|---|---|---|---|
| 1 | 100'/2 cotton/ 40D Lycra ® CSY | 44 dtex (40D) | 100'/2 siro spin 100% cotton | 3.5X | core spun |
| 2 | 100'/2 cotton/ 40D Lycra ® CSY | 44 dtex (40D) | 100'/2 siro spin 100% cotton | 3.5X | core spun |
| 3 | 100'/2 cotton/ 40D Lycra ® CSY | 44 dtex (40D) | 100'/2 siro spin 100% cotton | 3.5X | core spun |
| 4 | 100'/2 cotton/ 40D Lycra ® CSY | 44 dtex (40D) | 100'/2 siro spin 100% cotton | 3.5X | core spun |
| 5 | 100'/2 cotton/ 40D Lycra ® CSY | 44 dtex (40D) | 100'/2 siro spin 100% cotton | 3.5X | core spun |
| 6 | 150D Polyester/70D Lycra ® air cover | 78 dtex (70D) | 150D/34f textured polyester | 3.8X | air cover |
| 7 | 150D Polyester/70D Lycra ® air cover | 78 dtex (70D) | 150D/34f textured polyester | 3.8X | air cover |
| 8 | 70D Nylon/40D Lycra ® single cover | 44 dtex (40D) | 70D textured Nylon | 3.5X | Single cover |
| 9 | 70D Nylon/40D Lycra ® single cover | 44 dtex (40D) | 70D textured Nylon | 3.5X | Single cover |
| 10 | 70D Nylon/40D Lycra ® single cover | 44 dtex (40D) | 70D textured Nylon | 3.5X | Single cover |
| 11 | 70D Nylon/40D Lycra ® single cover | 44 dtex (40D) | 70D textured Nylon | 3.5X | Single cover |
| 12 | 70D Nylon/40D Lycra ® single cover | 44 dtex (40D) | 70D textured Nylon | 3.5X | Single cover |
| 13 | 70D Nylon/40D Lycra ® single cover | 44 dtex (40D) | 70D textured Nylon | 3.5X | Single cover |

TABLE 2

Fabric Example List

| Example | Core Warp Yarn | Base Warp Yarn | Weft Yarn | Base Weaving Pattern | Core Yarn Weave Pattern | Core Yarn Arrangement | Core Yarn Density on Loom (end/inch) |
|---|---|---|---|---|---|---|---|
| 1 | 100'/2 cotton/40D LYCRA ® CSY | 7.0' OE + 8.4' OE cotton indigo | 12' cotton/55D LYCRA ® CSY | 3/1 RHT | 3/1 | Match | 16 |
| 2 | 100'/2 cotton/40D LYCRA ® CSY | 7.0' OE + 8.4' OE cotton indigo | 12' cotton/55D LYCRA ® CSY | 3/1 RHT | 2/2 | Match | 16 |
| 3 | 100'/2 cotton/40D LYCRA ® CSY | 7.0' OE + 8.4' OE cotton indigo | 12' OE cotton/55D LYCRA ® CSY | 3/1 RHT | 1/1 | Match | 16 |
| 4 | 100'/2 cotton/40D LYCRA ® CSY | 7.0' OE + 8.4' OE cotton indigo | 12' OE cotton | 3/1 RHT | 3/1 | Dismatch | 16 |
| 5 | 100'/2 cotton/40D LYCRA ® CSY | 7.0' OE + 8.4' OE cotton indigo | 300D Coolmax ® polyester/40 LYCRA ® covered yarn | 3/1 RHT | 2/6 | Match | 16 |

TABLE 2-continued

Fabric Example List

| | | | | | | | |
|---|---|---|---|---|---|---|---|
| 6 | 150D Polyester/ 70D LYCRA ® air cover | 7.0' OE + 8.4' OE cotton indigo | 20' cotton/ 70D LYCRA ® CSY | 3/1 RHT | 3/1 | Match | 8 |
| 7 | 150D Polyester/ 70D LYCRA ® air cover | 7.0' OE + 8.4' OE cotton indigo | 20' cotton/ 70D LYCRA ® CSY | 3/1 RHT | 2/2 | Match | 16 |
| 8 | 70D Nylon/ 40D LYCRA ® single cover | 7.0' OE + 8.4' OE cotton indigo | 12' cotton/ 55D LYCRA ® CSY | 3/1 RHT | 3/1 | Dismatch | 16 |
| 9 | 70D Nylon/ 40D LYCRA ® single cover | 7.0' OE + 8.4' OE cotton indigo | 9.4' cotton/ 70D LYCRA ® CSY | 3/1 RHT | 1/3 | Dismatch | 16 |
| 10 | 70D Nylon/ 40D LYCRA ® single cover | 7.0' OE + 8.4' OE cotton indigo | 9.4' cotton/ 70D LYCRA ® CSY | 3/1 RHT | 2/2 | Dismatch | 16 |
| 11 | 70D Nylon/ 40D LYCRA ® single cover | 7.0' OE + 8.4' OE cotton indigo | 14' cotton/ 70D LYCRA ® CSY | 3/1 RHT | 3/1 | Dismatch | 16 |
| 12 | 70D Nylon/ 40D LYCRA ® single cover | 7.0' OE + 8.4' OE cotton indigo | 9.4' cotton/ 70D LYCRA ® CSY | 2/2 RHT | 2/2 | Match | 16 |
| 13 | 70D Nylon/ 40D LYCRA ® single cover | 7.0' OE + 8.4' OE cotton indigo | 9.4' cotton/ 70D LYCRA ® CSY | 2/2 RHT | 2/2 | Match | 16 |

| Example | Base Fabric on Loom (Warp EPI × weft PPI) | Max Surface Grin-through Count | Max Back Grin-through Count | Finished Fabric Width, inch | Fabric Weight OZ/Y2 | Fabric Stretch (Warp × weft) % | Fabric Growth (Warp × weft) % |
|---|---|---|---|---|---|---|---|
| 1 | 64 × 41 | 1 | 1 | 53.6 | 13.9 | 13.3 × 24.9 | 3.8 × 4.3 |
| 2 | 64 × 41 | 0 | 1 | 53.3 | 13.9 | 12.3 × 25.7 | 4.4 × 5.6 |
| 3 | 64 × 41 | 1 | 2 | 53.8 | 13.8 | 12.2 × 26.1 | 3.3 × 4.3 |
| 4 | 64 × 40 | 1 | 1 | NA | 10.8 | 17.3 × NA | 3.1 × NA |
| 5 | 64 × 45 | 1 | 1 | 57.3 | 12.1 | 11.7 × 16.5 | 2.7 × 1.7 |
| 6 | 64 × 57 | 0 | 1 | NA | 14.5 | 12 × 39.8 | 2.5 × 3.4 |
| 7 | 64 × 57 | 0 | 1 | NA | 14.3 | 13.3 × 32.5 | 2 × 2.9 |
| 8 | 64 × 41 | 1 | 1 | 63.8 | 13.5 | 14.8 × 28.1 | 4.4 × 4.4 |
| 9 | 64 × 40 | 1 | 1 | 62.6 | 14.5 | 14.1 × 29.5 | 4.3 × 5.1 |
| 10 | 64 × 40 | 1 | 1 | 64.4 | 14.4 | 12.8 × 24.3 | 3.7 × 3.7 |
| 11 | 64 × 47 | 1 | 1 | 64.5 | 12.9 | 13.5 × 25.3 | 3.8 × 4.2 |
| 12 | 64 × 40 | 2 | 2 | 52.5 | 15 | 12.5 × 25.5 | 4.2 × 4.8 |
| 13 | 64 × 40 | 2 | 2 | 50.4 | 21 | 38.3 × 23.4 | 14.3 × 2.9 |

| Example | Fabric Shrinkage % (Warp × weft) | Spandex Content in Warp Direction % | Warp Core Yarn Spandex Content Within Whole Fabric % | Warp Core Yarn Content With Warp % | Ratio of Core Yarn Denier vs. Base Yarn Denier % |
|---|---|---|---|---|---|
| 1 | 1.1 × 4.4 | 0.397 | 0.26 | 3.71 | 15.4 |
| 2 | 7.0 × 4.4 | 0.397 | 0.26 | 3.71 | 15.4 |
| 3 | 4.6 × 2.7 | 0.397 | 0.26 | 3.71 | 15.4 |
| 4 | 5.2 × 1 | 0.397 | 0.26 | 3.71 | 15.4 |
| 5 | 0.5 × 4.2 | 0.397 | 0.26 | 3.71 | 15.4 |
| 6 | 6.3 × 9.7 | 0.63 | 0.4 | 3.44 | 21.7 |
| 7 | 8.3 × 5.9 | 0.63 | 0.4 | 3.44 | 21.7 |
| 8 | 6.0 × 5.9 | 0.4 | 0.26 | 2.47 | 10.1 |

TABLE 2-continued

| Fabric Example List | | | | | |
|---|---|---|---|---|---|
| 9 | 4.5 × 7.0 | 0.4 | 0.26 | 2.47 | 10.1 |
| 10 | 4.5 × 7.2 | 0.4 | 0.26 | 2.47 | 10.1 |
| 11 | 4.1 × 5.8 | 0.4 | 0.26 | 2.47 | 10.1 |
| 12 | 4.2 × 4.9 | 0.4 | 0.26 | 2.47 | 10.1 |
| 13 | 5.2 × 7.6 | 0.4 | 0.26 | 2.47 | 10.1 |

Example 1

Bi-stretch Denim with 3/1 Core Yarn Pattern

Figure 9:
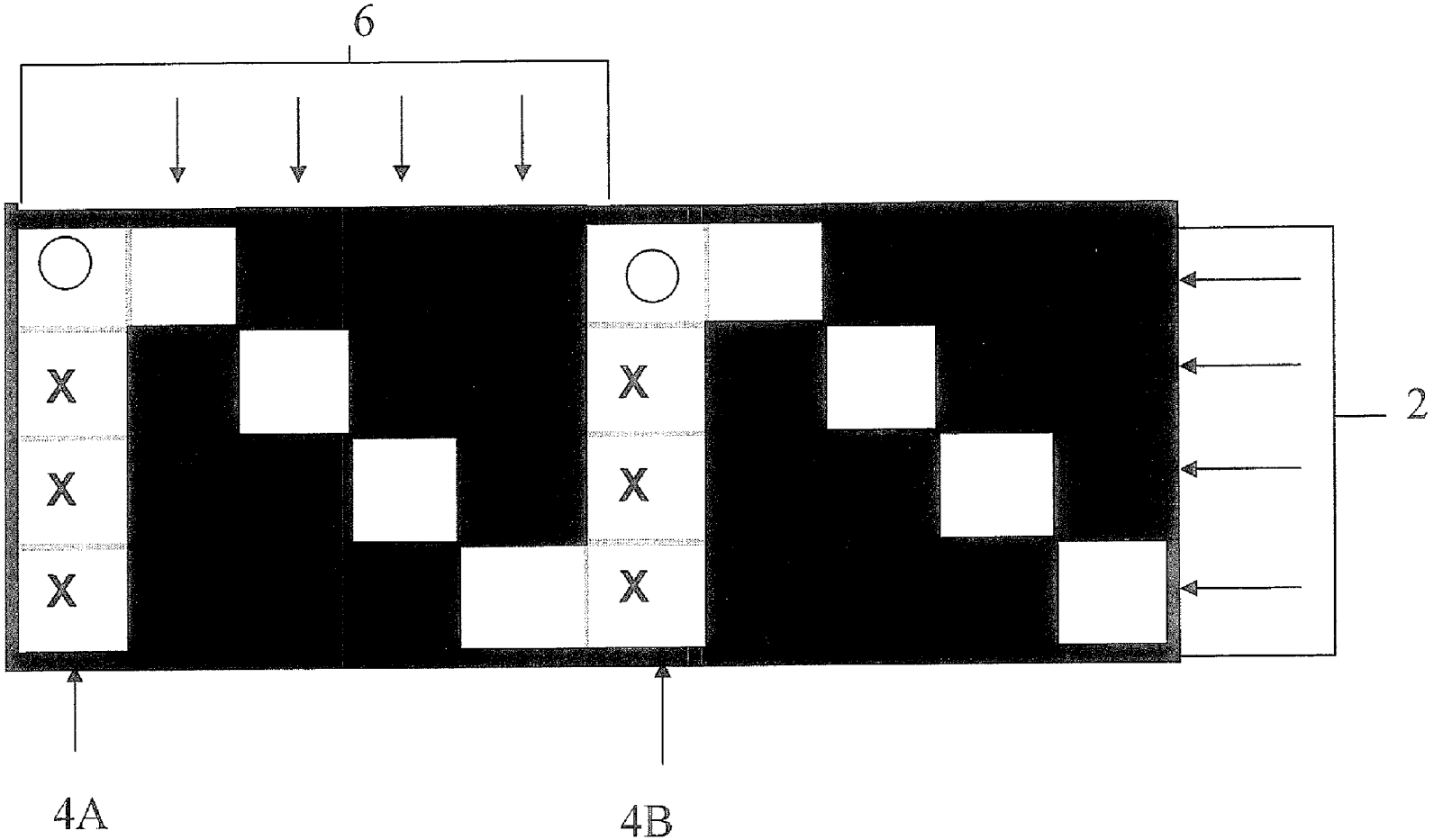
FIG. 9 Lift Plan for 3/1 twill +3/1 match structure.

The warp surface yarn was 7.0 Ne count and 8.4 Ne count mixed open end yarn. The warp yarn was indigo dyed before beaming. The core warp yarn is 100/2 Ne Siro core spun yarn with 40 D LYCRA® spandex. The weft yarn was 12 Ne cotton with 55 D LYCRA® core spun yarn. LYCRA® draft is 3.6×. Loom speed was 500 picks per minute at a pick level 41 Picks per inch. Warp core yarn use 1 down and 3 up weave pattern. It uses a match pattern as well (FIG. 9). Table 2 summarizes the test results. The test results show that after washing, this fabric had weight (13.9 OZ/$Y^2$), 13.3% and 24.9% stretch, 3.8% and 4.3% growth in warp and weft respectively. All these data indicate that this combination of core stretch yarn and surface hard yarn and fabric construction can produce good fabric stretch and growth. Fabric has no grin-through; core warp yarn cannot be seen from both surface and back.

Example 2

Bi-stretch Denim with 2/2 Core Yarn Pattern

This sample had the same fabric structure as in example 1. The only difference was the use of 2 up and 2 down weaving pattern for warp core elastic yarn. The warp surface yarn was 7.0 Ne count and 8.4 Ne count mixed open end yarn. The warp yarn was indigo dyed before beaming. The core warp yarn is 100/2 Ne Siro core spun yarn with 40 D LYCRA® spandex. The weft yarn was 12 Ne cotton with 55 D LYCRA® core spun yarn. The loom speed was 500 picks/minute at 41 picks per inch. Table 2 summarizes the test results. It is clear that this sample had good stretch (warp 12.3%×weft 25.7%). And 53.3 inch of width. The fabric also has low shrinkage. So a heatset process was not necessary for this sample. Without heatset, fabric appearance and handle were improved.

Example 3

Bi-stretch Denim with 1/1 Core Yarn Pattern

Figure 4:
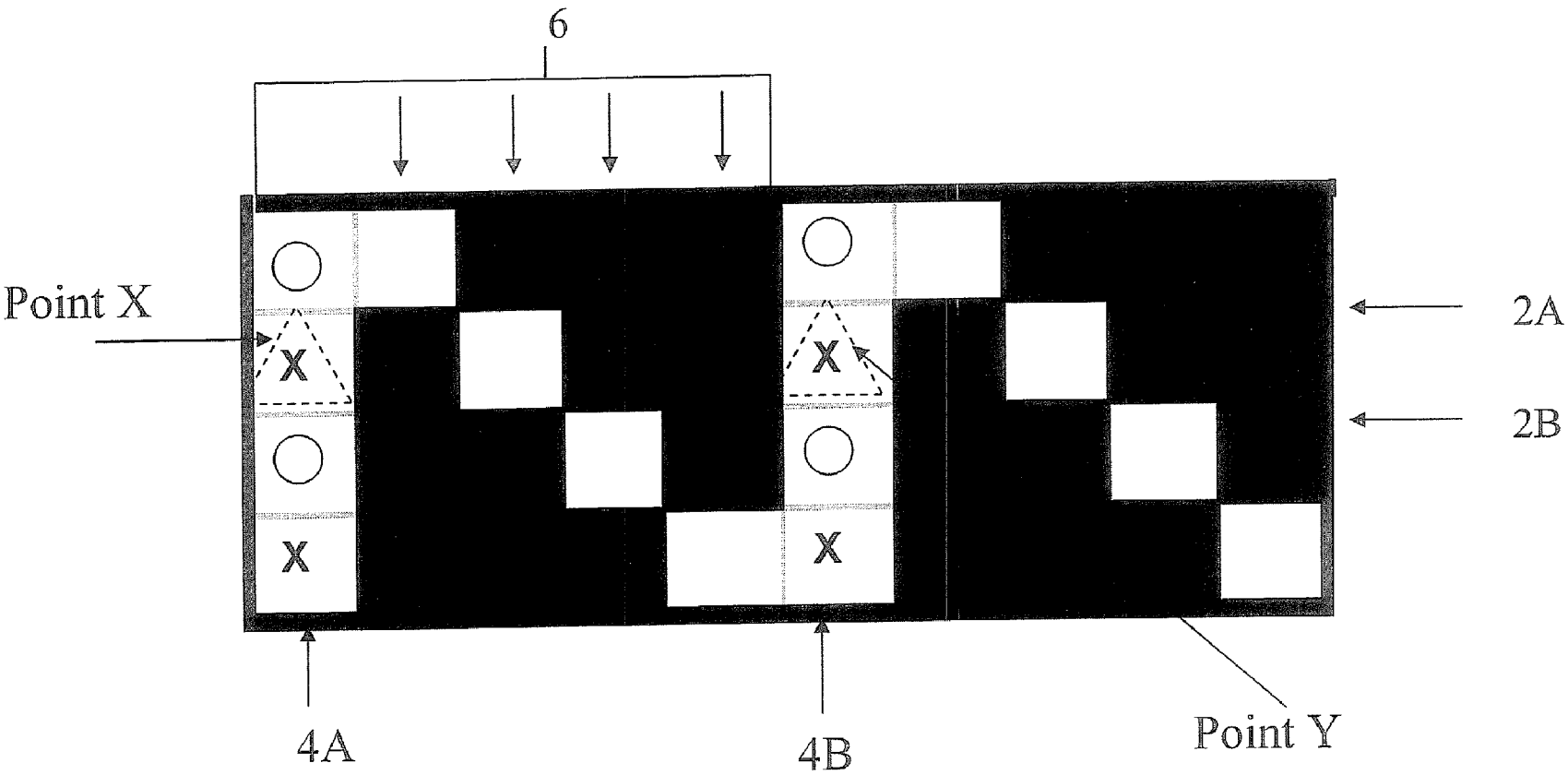
FIG. 4 Lift Plan for 3/1 twill +1/1 match Structure.

This fabric used the same warp and weft yarn as Example 1 and Example 2. Also, the weaving and finishing process were the same as Example 2 and 3, but its weave pattern for elastic core warp yarn was 1/1 plain (FIG. 4). Table 2 summarizes the test results. We can see that this sample had weight (13.8 Oz/Y^2), good stretch (warp 12.2%×Weft 26.1%), and acceptable wash shrinkage (warp 4.6%×weft 2.7%). Again, a heatset process was not necessary for this sample. The fabric appearance and handle was excellent.

Example 4

Warp Stretch Denim

The warp surface yarn was 7.0 Ne count and 8.4 Ne count mixed open end yarn. The warp yarn was indigo dyed before beaming. The core warp yarn is 100/2 Ne Siro core spun yarn with 40 D LYCRA® spandex. The weft yarn was 12 Ne of 100% cotton open end yarn. This weft yarn is rigid and inserted into fabric as weft yarn at 40 picks/inch on the loom. 3/1 twill weaving pattern for surface yarn. Without heat setting, the sample had 17% stretch and 3.1% growth in the warp direction. It is an ideal fabric for making warp stretch jean.

Example 5

Bi-stretch Denim with Polyester/LYCRA® Air Covered Yarn

The weft yarn was 300 D/68 F Coolmax®) polyester filament with 40 D LYCRA® spandex air covered yarn. The warp surface yarn was 7.0 Ne count and 8.4 Ne count mixed open end indigo yarn. The core warp yarn is 100/2 Ne Siro core spun yarn with 40 D LYCRA® spandex. The weaving pattern is shown in FIG. 9. Before weaving, the stretch weft yarn went through interlacing process. After weaving the greige fabric was finished in giggle dye machine.

In the finished fabric, the warp and weft density of the cotton yarn was 77 end/in×55 picks/in, the basis weight was 15.4 OZ/$yd^2$, and the elongation was 11.7 in warp and 16.5% in weft %. The Fabric had very low shrinkage: 0.5% in warp and 4.2% in weft.

Example 6

Bi-Stretch Denim with Polyester/LYCRA® Air Covered Yarn

In this example the warp core elastic yarn is 150 D polyester/70 D LYCRA® air covered yarn. The ratio of elastic core yarn vs. surface yarn is 1:8. There is one core elastic yarn among every eight surface hard yarn. The fabric has the same warp surface yarn and same fabric structure as in Example 1. 20 Ne cotton/70 D LYCRA® core spun was used as weft yarn. The LYCRA® was drafted 3.5× during covering process. Table 2 lists the fabric properties. The fabric made from such yarn exhibited low shrinkage, good stretch (12%×39.8%). No fabric heat setting was necessary.

Example 7

Bi-stretch Denim with 2/2 Polyester/LYCRA® Air Covered Yarn

This example had the same warp surface yarn and same fabric structure as Example 7, except 2/2 weave pattern for core elastic yarn. There is one end of core elastic yarn among every four surface yarn. 20 Ne cotton/70 D LYCRA® core spun yarn is used as weft yarn. From Table I, we can the fabric properties.

Example 8

Bi-stretch Denim with 3/1 Single Covered Yarn Pattern

This sample is the example of using Nylon/LYCRA® single covered yarn as core elastic yarn. 40 D LYCRA® is covered by 70 D Nylon through single cover method. The warp surface yarn was 7.0 Ne count and 8.4 Ne count mixed open end yarn. The warp yarn was indigo dyed before beaming. The weft yarn was 12 Ne cotton with 55 D LYCRA® core spun yarn. LYCRA® draft is 3.6×. Loom speed was 500 picks per minute at a pick level 41 Picks per inch. Warp core yarn use 1 down and 3 up weave pattern. It uses a dismatch pattern. Table 2 summarizes the test results. The test results show that after washing, this fabric had weight (13.5 OZ/$Y^2$), 14.8% and 28.1% stretch, 4.4% and 4.4% growth in warp and weft respectively. Fabric has no grin-through; core warp yarn cannot be seen from both surface and back.

Example 9

Bi-stretch Denim with 1/3 Mismatch Pattern

This sample had the same fabric structure as in example 8. The only difference was the use of 9.4 Ne cotton/70 D LYCRA® core spun as weft. The warp surface yarn was 7.0 Ne count and 8.4 Ne count mixed open end yarn. The warp yarn was indigo dyed before beaming. The core warp yarn is 70 D Nylon/40 D LYCRA® single covered yarn. Table 2 summarizes the test results. It is clear that this sample had good stretch (warp 14.1%×weft 29.5%). And 62.6 inch of width. The fabric also has low shrinkage. So a heatset process was not necessary for this sample.

Example 10

Bi-stretch Denim with 1/1 Core Yarn Pattern

This fabric used the same warp and weft yarn as Example 9. Also, the weaving and finishing process were the same as Example 9, but its weave pattern for elastic core warp yarn was 2/2. Table 2 summarizes the test results. We can see that this sample had weight (14.4 Oz/Y^2), good stretch (warp 12.8%×Weft 24.3%), and acceptable wash shrinkage (warp 4.4%×weft 7.2%). Again, a heatset process was not necessary for this sample.

Example 11

Bi-stretch Denim

This is a middle weight of denim fabric. The warp surface yarn was 7.0 Ne count and 8.4 Ne count mixed open end yarn. The core warp yarn is 70 Ne single covered yarn with 40 D LYCRA® spandex. The weft yarn was 14 Ne/70 D LYCRA ® core spun yarn. This weft yarn is inserted into fabric as weft yarn at 47 picks/inch on the loom. 3/1 twill weaving pattern for base yarn. Without heat setting, the sample had 13.5% stretch and 3.8% growth in the weft direction.

Example 12

Stretch 2/2 Twill Denim with Grin-through

Figure 10:
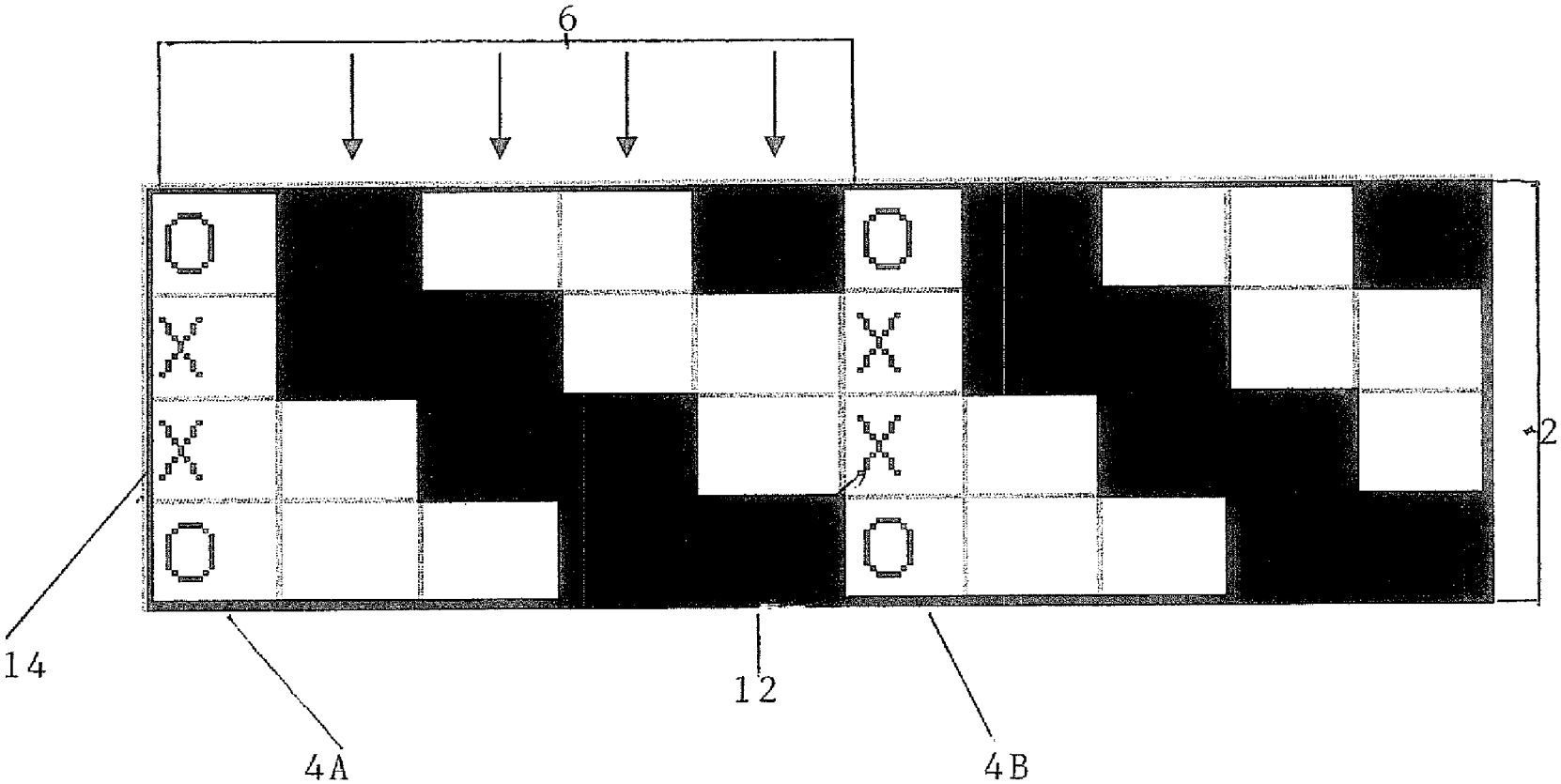
FIG. 10 Lift Plan for 2/2 twill +2/2 match structure.

This is a comparison sample, not according to the invention. The warp surface yarn was 7.0 Ne count and 8.4 Ne count mixed indigo open end yarn. The core warp yarn is 70 Ne single covered yarn with 40 D LYCRA® spandex. The weave pattern for warp core yarn is 2/2 weave and match (FIG. 10): with different weave pattern in neighbored core yarn. The exposure index for this fabric is 2 for both surface and back of the fabric. The physical properties of this fabric is good (see Table 2), but there was grin-through of core elastic yarn on the fabric surface and back. Core elastic yarns are exposed and clearly show up on fabric surface.

Example 13

Stretch 2/2 Twill Denim with 6/2 Core Yarn Exposed

Figure 11:
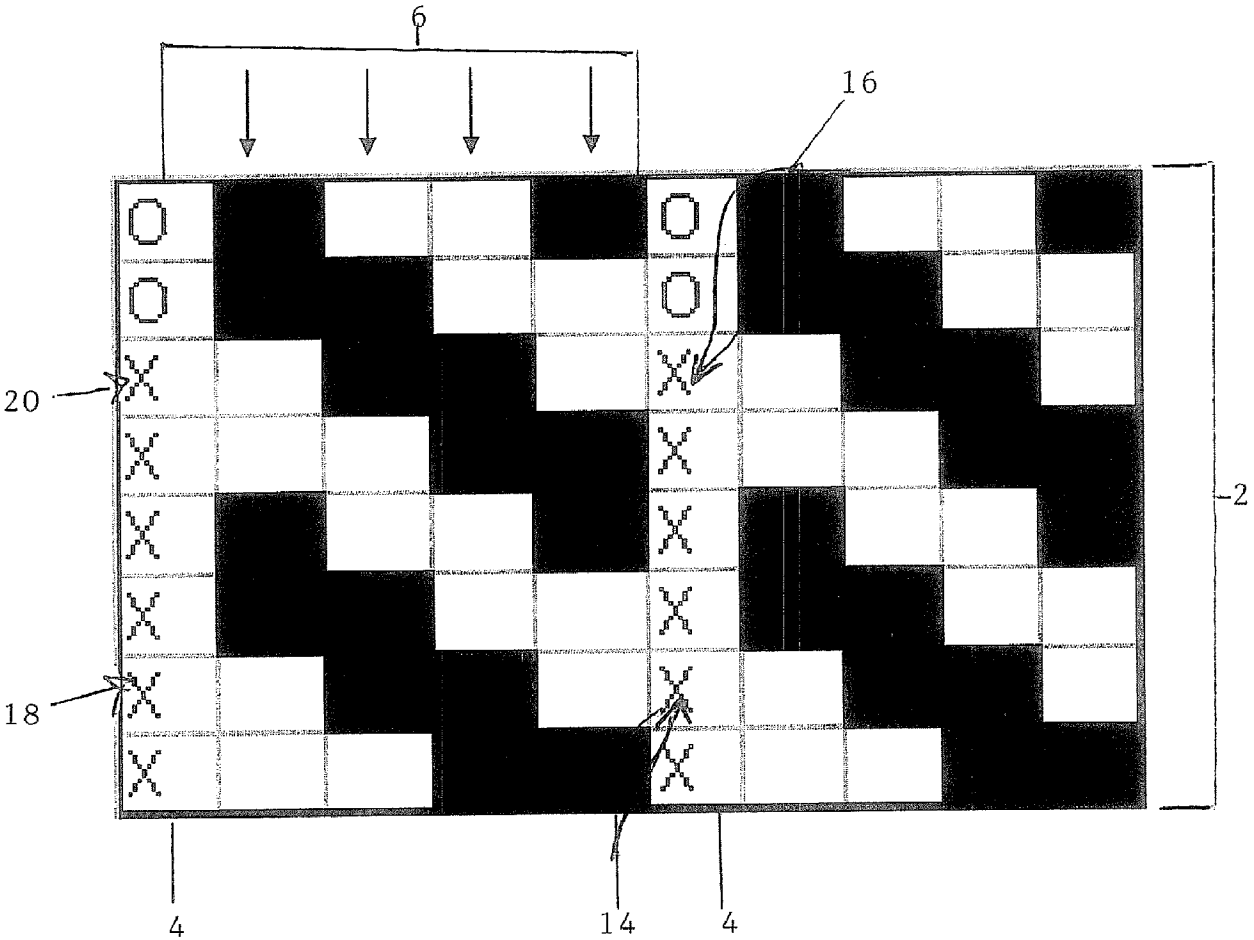
FIG. 11 Lift Plan for 2/2 twill with long float structure.

This is another comparison sample, not according to the invention. The warp surface yarn was 7.0 Ne count and 8.4 Ne count mixed indigo open end yarn. The core warp yarn is 70 Ne single covered yarn with 40 D LYCRA® spandex. The weave pattern for warp core yarn is 6/2 weave (FIG. 11). It has a long float for core elastic yarn. The fabrics show wrinkle and crease after finishing. The exposure index for this fabric is 2 for both surface and back of the fabric. The physical properties of this fabric is also good (see Table 2), but there are grin-through of core elastic yarn on the fabric surface and back. Core elastic yarns are exposed and clearly show up on fabric surface.

What is claimed is:

1. An article comprising a woven fabric having warp yarns and weft yarns, wherein at least one of the warp yarns and weft yarns have two separate systems of yarns; said systems of yarns include a hard yarn forming the main body of fabric and a composite covered elastic yarn with an elastic yarn core;

wherein the fabric has an outer face side, a back side, and includes at least one of:

(a) a weaving pattern where the composite yarn and at least one adjacent hard yarn pass over the same pick or warp yarn when the composite yarn is on the outer surface;

(b) the ratio of hard yarn denier to composite yarn denier is about 2:1 to about 10:1; and (c) the composite yarn floats over no more than 5 picks or warp yarns on the outer face side.

2. The article of claim 1, wherein the yarn end ratio of the base yarn to the core yarn is from about 2:1 to about 8:1.

3. The article of claim 1, wherein the amount of elastic fiber present in the warp yarns is from about 0.1% to about 5% by weight of the warp yarns.

4. The article of claim 3, wherein the amount of elastic fiber is present in the weft yarns from about 0.1% to about 5% by weight of the weft yarns.

5. The article of claim 1, wherein the elastic yarn is spandex.

6. The article of claim 1, wherein the composite covered elastic yarn is selected from the group consisting of core spun yarn, air covered yarn, single wrapped yarn, double wrapped yarn, and combinations thereof.

7. The article of claim 1, wherein the hard yarn forming the main body of fabric is selected from staple spun yarn, filament yarn, and combinations thereof.

8. The article of claim 1, wherein the hard yarn forming the main body of fabric is selected from the group consisting of wool, linen, silk, polyester, nylon, olefin, cotton, and combinations thereof.

9. The article of claim 1, wherein fabric has a weaving pattern selected form the group consisting of plain, twill, satin, and combinations thereof.

10. The article of claim 1, wherein the fabric weaving pattern for the hard yarn and the composite yarn is different.

11. The article of claim 1, wherein the fabric has stretch in the warp direction between about 10 and about 45%.

12. The article of claim 1, wherein the elastic fiber core has a denier from about 10 D to about 400 D.

13. The article of claim 1, wherein said article is a garment.

14. An article comprising a woven fabric having warp yarns and weft yarns, wherein at least one of the warp yarns or weft yarns have two separate systems of yarns; said systems of yarns include a hard yarn forming the main body of fabric and a composite covered elastic yarn with an elastic yarn core;

wherein the fabric has an outer face side, a back side, and the fabric includes:

(a) a weaving pattern where the composite yarn and at least one adjacent hard yarn pass over the same pick or warp yarn when the composite yarn is on the outer surface;

(b) the ratio of hard yarn denier to composite yarn denier is about 2:1 to about 10:1; and (c) the composite yarn floats over no more than 5 picks or warp yarns on the outer face side.

* * * * *